US005772064A

United States Patent [19]

Delbrouck

[11] Patent Number: 5,772,064

[45] Date of Patent: Jun. 30, 1998

[54] WINDOW-SIDED PLASTIC BOTTLE CASE

[75] Inventor: Klaus Delbrouck, Köln, Germany

[73] Assignee: Franz Delbrouck GmbH, Menden, Germany

[21] Appl. No.: 761,157

[22] Filed: Dec. 6, 1996

[30] Foreign Application Priority Data

Dec. 7, 1995 [DE] Germany ..... 295 19 374 U

[51] Int. Cl.[6] ..... B65D 1/24

[52] U.S. Cl. ..... 220/515; 220/509; 206/429; 206/427

[58] Field of Search ..... 220/509, 524, 220/515, 579; 200/429, 427

[56] References Cited

U.S. PATENT DOCUMENTS

| | | | |
|---|---|---|---|
| 2,886,202 | 5/1959 | Waller | 220/509 |
| 3,029,970 | 4/1962 | Brandon | 220/509 |
| 4,295,576 | 10/1981 | Steinlein | 220/515 |
| 4,538,742 | 9/1985 | Prodel | 220/515 |
| 5,487,487 | 1/1996 | Hammett | 220/509 |

FOREIGN PATENT DOCUMENTS 33 00 590 7/1984 Germany .

*Primary Examiner*—Joseph M. Moy

*Attorney, Agent, or Firm*—Herbert Dubno; Andrew Wilford

[57] ABSTRACT

A plurality of substantially identical bottles each have a generally cylindrical body centered on a bottle axis and having a lower end and a ring on the lower end and of greater diameter than the respective body to project radially therepast. A plastic case has a plurality of side walls each formed by at least one lower web with a relatively large window opening and inner walls spaced inward from the side walls and defining therewith a plurality of seats each centered on a respective normally upright seat axis. A respective relatively short outer retaining formation projects radially of the respective seat axis below the respective window from the respective lower web into each seat and has an inner edge spaced from the respective seat axis by a distance equal generally to half the outside diameter of the bottle ring. A respective inner retaining formation projects radially of the respective seat axis to each seat and has an inner edge spaced from the respective seat axis by a distance equal generally to half the outside diameter of the bottle body. Each inner formation is wholly above the respective outer formation.

7 Claims, 4 Drawing Sheets

WINDOW-SIDED PLASTIC BOTTLE CASE

FIELD OF THE INVENTION

The present invention relates to a bottle case. More particularly this invention concerns an open-or window-sided bottle case made out of plastic for normally plastic bottles.

BACKGROUND OF THE INVENTION

It is standard to transport and stock bottles in cases that normally hold twelve bottles and that can be used to transport the empty bottles back to the distributor for recycling. The bottles and cases are normally made of plastic and each case is formed with a plurality of seats each dimensioned to hold a single respective bottle.

In order to make it easy for the delivery person to ascertain which cases contain which bottles, the cases are made with relatively large window openings on their side and end walls and the case-loading machine positions the bottles in the cases with their labels or other product-identifying indicia directed outward through the windows. Thus the delivery person can look at a case and readily see what it contains.

In such an arrangement the hitherto known systems for retaining and centering the bottles in the seats as described in German patent document 3,300,590 cannot be used because they would obscure the information on the bottle. In addition it is nowadays standard to form bottles of plastic, typically of PET, with a basically cylindrical body and a bulged-out ring on the lower end, so that such bottles fit fairly loosely in the known cases.

The result is that the bottles jiggle, creating noise, and rotate, moving their labels out of alignment with the case windows, when the case is vibrated as occurs naturally in transit. Thus the delivery person must put up with the noise created by the loose bottles as the cases are moved, and often cannot read what is on the bottles. If the retaining devices are made fairly tight, they can inhibit entry altogether of bottles with lower-end rings, and can make it necessary to force empty bottles down into the seats, as their weight alone is not enough to deflect the retaining formations. What is more when the seats are quite tight or are constructed to be deflected elastically outward when a bottle is inserted, it is fairly difficult for a case-loading machine to accurately position the bottles in the seats, a problem aggravated by the normally high center of mass of such bottles.

OBJECTS OF THE INVENTION

It is therefore an object of the present invention to provide an improved bottle case.

Another object is the provision of such an improved bottle case which overcomes the above-given disadvantages, that is which holds modern plastic bottom-ring bottles securely so they do not vibrate or rotate, but that allows the bottles to be easily and surely set into the seats, even when empty.

SUMMARY OF THE INVENTION

A plurality of substantially identical bottles each have a generally cylindrical body centered on a bottle axis and having a lower end and a ring on the lower end and of greater diameter than the respective body to project radially therepast. A plastic case has a plurality of side walls each formed by at least one lower web with a relatively large window opening and inner walls spaced inward from the side walls and defining therewith a plurality of seats each centered on a respective normally upright seat axis. A respective relatively short outer retaining formation projects radially of the respective seat axis below the respective window from the respective lower web into each seat and has an inner edge spaced from the respective seat axis by a distance equal generally to half the outside diameter of the bottle ring. A respective inner retaining formation projects radially of the respective seat axis to each seat and has an inner edge spaced from the respective seat axis by a distance equal generally to half the outside diameter of the bottle body. Each inner formation is wholly above the respective outer formation.

Thus with his system a bottle is engaged at the ring below the window by the outer retaining formation and thereabove on the inside where it does not matter by the inner retaining formation. The bottle must be tipped somewhat to be set in the seat, but this is not usually a problem and, once in place, the bottle is positively engaged in two diametrically opposite directions by the retaining formations so it is solidly held and will neither rattle nor rotate if the case is vibrated. The plastic bottles are themselves fairly flexible and elastically deformable so even if they are a little oversized they will be surely gripped and held in the seats.

According to the invention the inner edge of each inner retaining formation is spaced radially from the respective seat axis by a distance equal to at most half the diameter of the bottle body and the inner edge of each outer retaining formation is spaced radially from the respective seat axis by a distance equal to at most half the diameter of the ring. In addition the inner edge of each inner retaining formation is inclined downward toward the respective seat axis and is spaced at its lower end from the respective seat axis by a distance equal to at most half the diameter of the bottle body.

Each bottle has when filled a center of mass lying on the respective bottle axis above a lowermost end of the respective inner retaining formation. Furthermore at least one of the retaining formations of each seat is radially elastically limitedly deformable. More particularly is formed as at least one upright rib formed unitarily with the case. At least the outer retaining formations are each formed as a pair of angularly spaced and radially inwardly directed ribs formed unitarily with the case.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
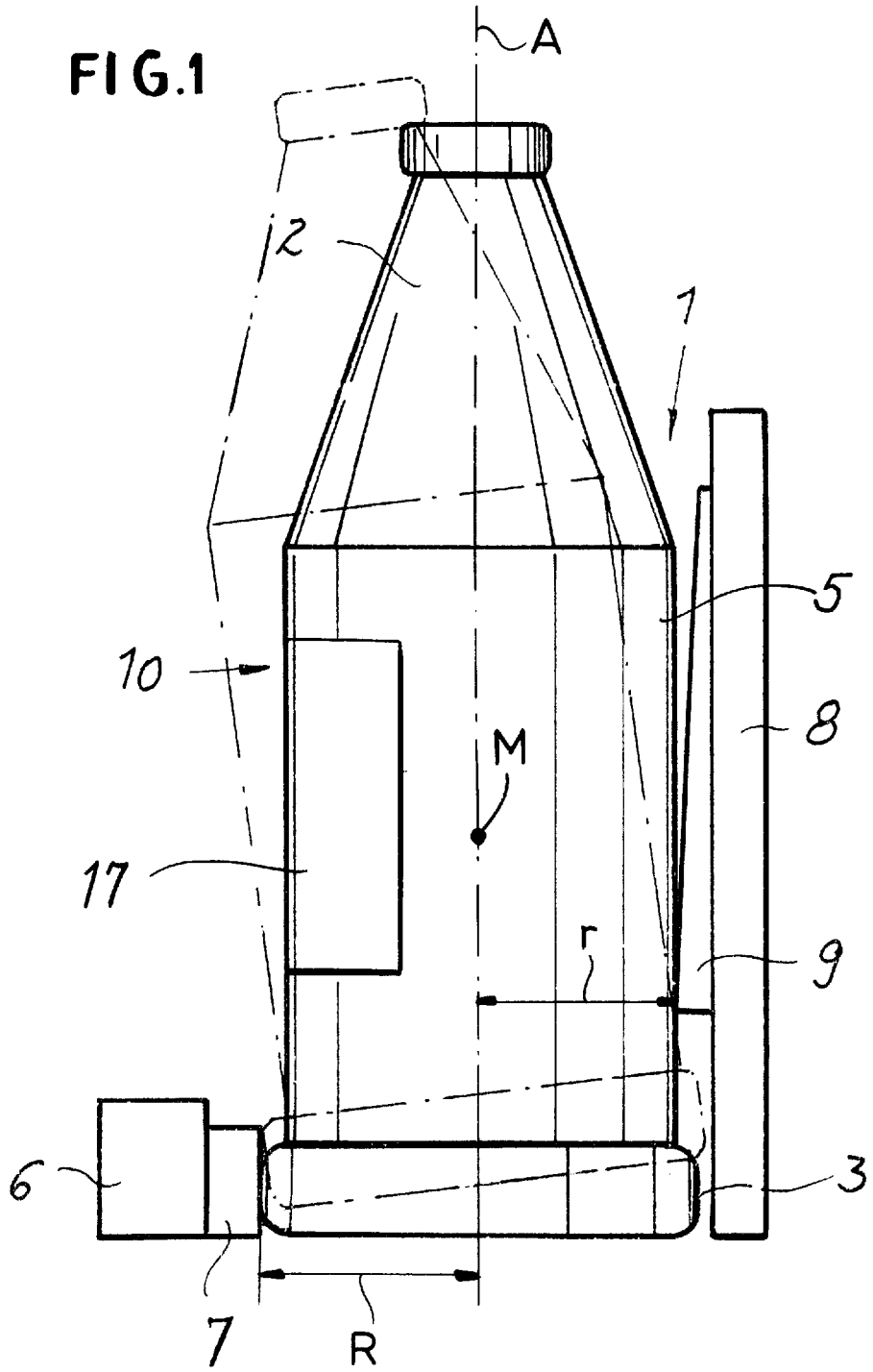
FIG. 1 is a side view of a bottle seat and bottle according to the invention.
Figure 2:
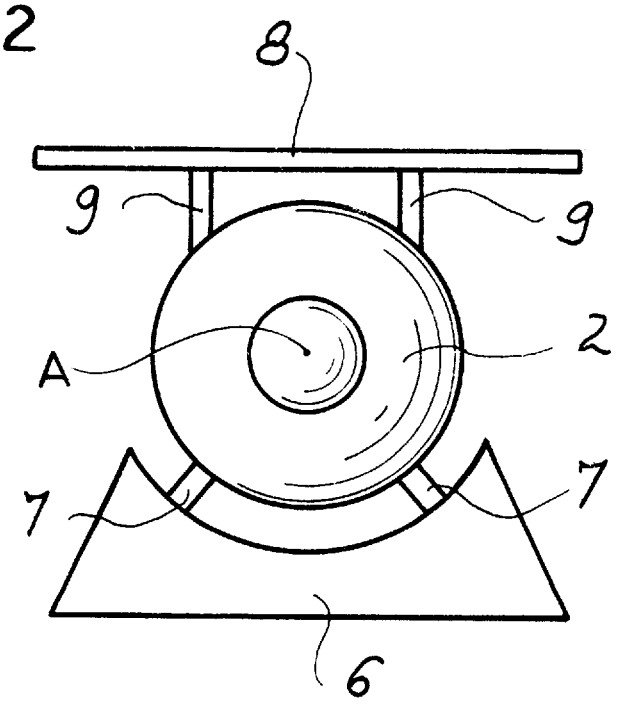
FIG. 2 is a top view of the structure of FIG. 1.
Figure 4:
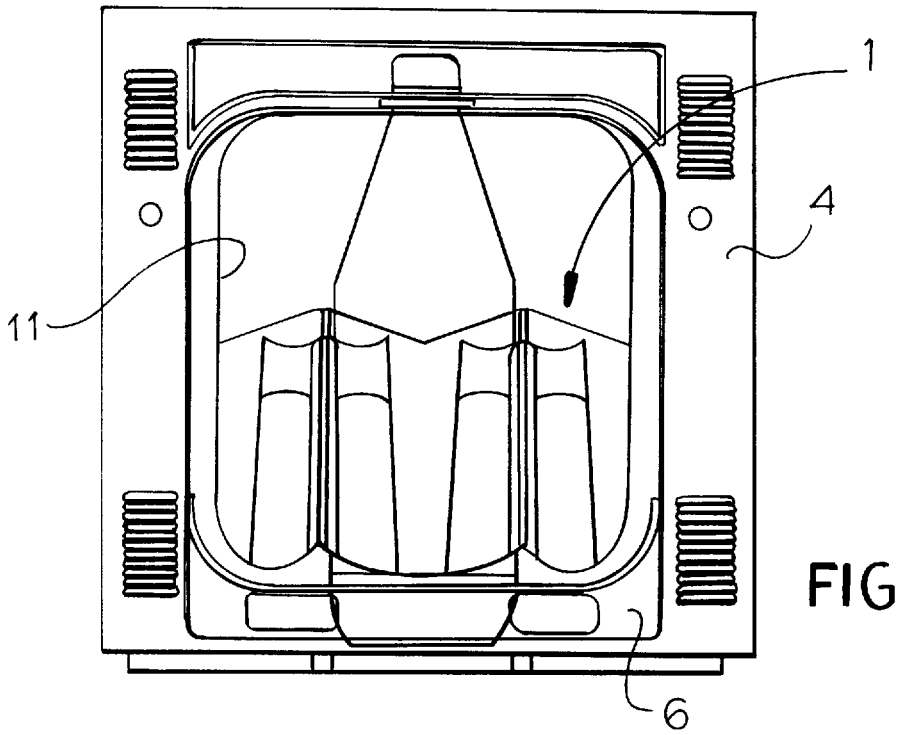
FIGS. 4, 5, and 6 are small-scale end, side, and top views, respectively, of a window-sided bottle case according to the invention.
Figure 5:
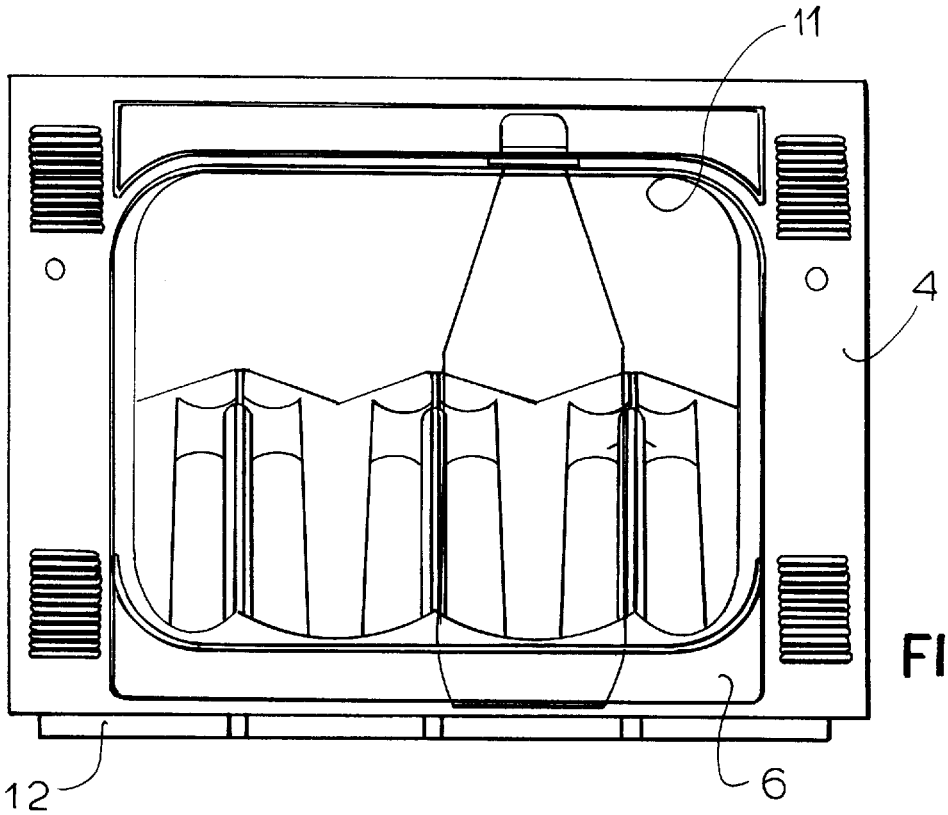
Figure 6:
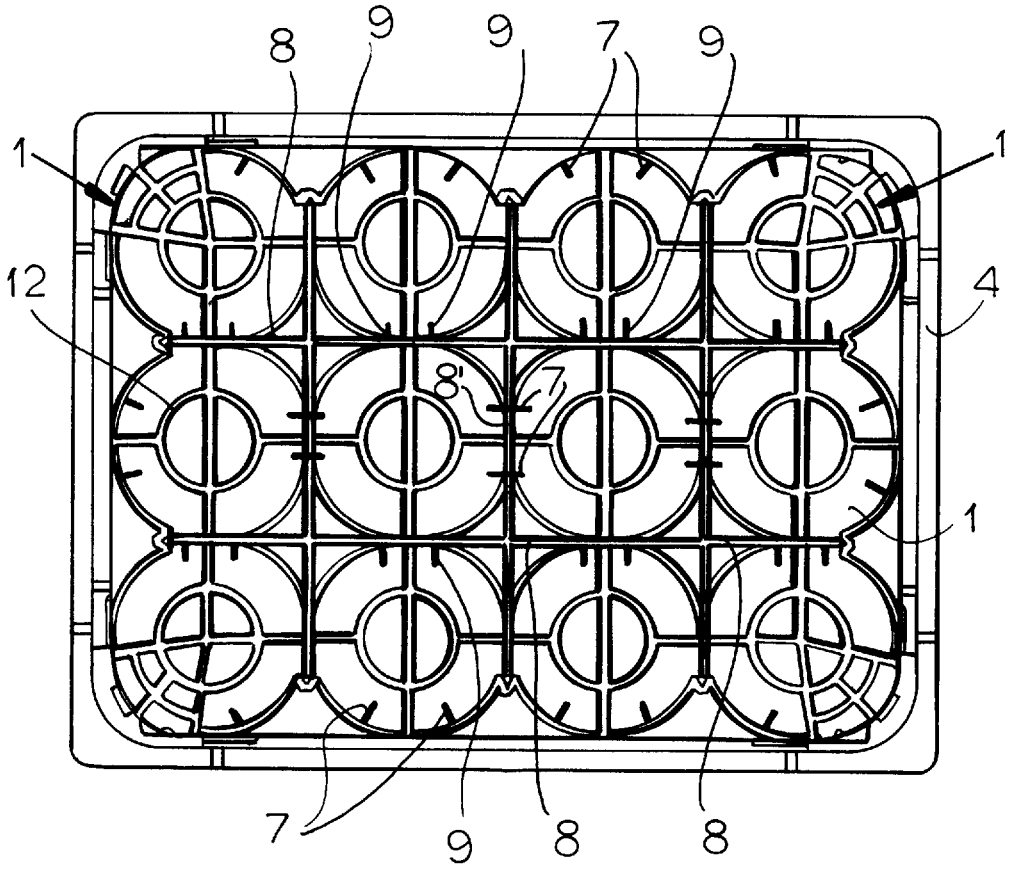

As seen in FIGS. 1, 2, and 4 a plastic bottle case 4 is formed with twelve seats 1 each adapted to hold a bottle 2 and each centered on an upright axis A. The case 4 has side and end walls formed with large openings or windows 11 and a grid-like floor 12 on which the bottles 2 sit. Such a case 4 is used for delivering full bottles and taking back empty ones.

Each bottle 2 has a basically cylindrical small-diameter body 5 provided on its lower end with a ring 3 of larger diameter but coaxial with the body 5, so that this ring 3 projects past the body 5. The bottom corner of the bottle 2 where the ring 3 joins the bottom of the bottle 2 is curved. Such a bottle 2 is normally made of plastic also and normally holds a quart or liter of liquid. Each such bottle 2 carries a label or indicia 13 oriented when the case 4 is loaded to point outward and be readable through the respective window 11. A center of gravity or mass M of the bottle 2 lies on the axis A.

According to the invention the seats 1 are formed either between lower outer webs 6 of the case 4 that define the lower edges of the windows 11 and by internal walls or webs 8, or for the center-most seats 1 are formed wholly by the interior walls or webs 8. The interior webs 8 are substantially taller than the outside webs 6 since it is irrelevant that view of the label or indicia 13 be blocked from inside the case 4 although the innermost web 8' can be short like the webs 6.

Each seat 1 on the respective rib 6 or 8' is formed in accordance with this invention by a lower and relatively short retaining formation 7 here formed as two short ribs oriented at 90° relative to each other relative to the respective axis A. Each such rib 7 has an inner edge extending parallel to the respective axis A. In addition each seat 1 has an inner retaining formation 9 formed as two longer ribs 9 carried on the inner web 8 and oriented at 90° relative to each other relative to the respective axis A. Each rib 9 has a lower end spaced well above the upper end of the respective ribs and also well above the ring 3 of the respective bottle 2 and has an inner edge that is angled downwardly inward so as to form with a line parallel to the axis A an upwardly open very small acute angle. in addition the center M of mass of the bottle 2 is wholly above the lower formation 7 and even above the lower edge of the upper formation 9.

The radial spacing r of the lower edge of the inner rib 9 from the respective axis A is equal to the radius of curvature of the body part 5 of the bottle 2 and the radial spacing R of the outer rib 7 from the respective axis A is equal to the radius of curvature of the ring part 3 of the bottle 2.

Figure 3:
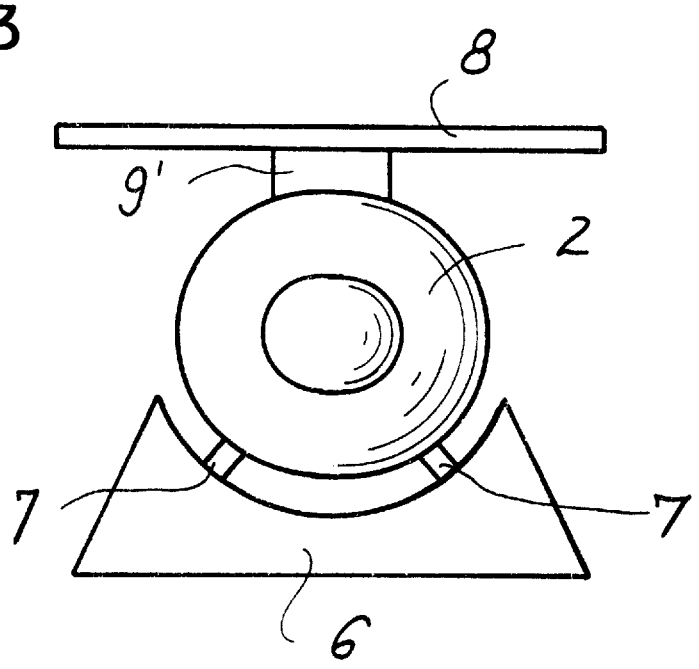
FIG. 3 is a view like FIG. 2 of a variant on the structure.

FIG. 3 shows how instead of a pair of angularly spaced ribs 9 it is possible to have a single block 9' as inside retaining formation.

In order to seat a bottle 2 in the seat 1 it is first fitted at an angle as indicated by dot-dash lines in FIG. 1 to the seat 1, and then released so it will stand up as shown in solid lines in FIG. 1. In this solid-line position the bottle 2 is solidly held on the outside by the formation 7 and on the inside by the formation 9 (or 9') so that it is not loose at all and will, therefore, not rattle or rotate. The bottles 2 have to be tipped inward to be removed. Even if a bottle 2 is slightly oversized as shown at FIG. 3, it will be held solidly with some deformation that can normally be accommodated by the bottle 2 with no problem.

I claim:

1. In combination:

a plurality of substantially identical bottles each having a generally cylindrical body centered on a bottle axis and having a lower end, and a ring on the lower end and of greater diameter than the respective body to project radially therepast;

a plastic case having a plurality of side walls each formed by at least one lower web with a relatively large window opening, inner walls spaced inward from the side walls and defining therewith a plurality of seats each centered on a respective normally upright seat axis, a respective relatively short outer retaining formation projecting radially of the respective seat axis below the respective window from the respective lower web into each seat and having an inner edge spaced from the respective seat axis by a distance equal generally to half the outside diameter of the bottle ring, and a respective inner retaining formation projecting radially of the respective seat axis to each seat and having an inner edge spaced from the respective seat axis by a distance equal generally to half the outside diameter of the bottle body, each inner formation being wholly above the respective outer formation.

2. The bottle/case combination defined in claim 1 wherein the inner edge of each inner retaining formation is spaced radially from the respective seat axis by a distance equal to at most half the diameter of the bottle body and the inner edge of each outer retaining formation is spaced radially from the respective seat axis by a distance equal to at most half the diameter of the ring.

3. The bottle/case combination defined in claim 1 wherein the inner edge of each inner retaining formation is inclined downward toward the respective seat axis and is spaced at its lower end from the respective seat axis by a distance equal to at most half the diameter of the bottle body.

4. The bottle/case combination defined in claim 1 wherein each bottle has when filled a center of mass lying on the respective bottle axis above a lowermost end of the respective inner retaining formation.

5. The bottle/case combination defined in claim 1 wherein at least one of the retaining formations of each seat is radially elastically limitedly deformable.

6. The bottle/case combination defined in claim 1 wherein each retaining formation is formed as at least one upright rib formed unitarily with the case.

7. The bottle/case combination defined in claim 1 wherein at least the outer retaining formations are each formed as a pair of angularly spaced and radially inwardly directed ribs formed unitarily with the case.

* * * * *